US006336223B1

(12) United States Patent
Snedeker

(10) Patent No.: US 6,336,223 B1
(45) Date of Patent: Jan. 8, 2002

(54) FIREFIGHTER COAT WITH LINER SLEEVE WELLS AND WRISTERS

(75) Inventor: Julie A. Snedeker, Northwood, NH (US)

(73) Assignee: Globe Manufacturing Company, Pittsfield, NH (US)

( * ) Notice: Subject to any disclaimer, the term of this patent is extended or adjusted under 35 U.S.C. 154(b) by 0 days.

(21) Appl. No.: 09/593,212

(22) Filed: Jun. 14, 2000

(51) Int. Cl.[7] ..... A41B 7/00; A62B 17/00
(52) U.S. Cl. ..... 2/97; 2/81; 2/123
(58) Field of Search ..... 2/97, 81, 13

(56) References Cited

U.S. PATENT DOCUMENTS 5,890,226 A * 4/1999 Snedeker et al. ..... 2/97

* cited by examiner

*Primary Examiner*—John J. Calvert
*Assistant Examiner*—James G Smith
(74) *Attorney, Agent, or Firm*—Dykema Gossett PLLC

(57) ABSTRACT

The lower open ends of the liner sleeves are detachably connected to the lower open end of the shell sleeves by two annular interengaging portions each of which is part of a hook and loop fastening means. Sleeve wells are provided within the lower ends of the liner sleeves by folding the inner moisture barrier of each liner sleeve upon itself and stitching the edge of the inner moisture barrier to a wrister. One annular portion is stitched to the lower end of the outer moisture barrier of each liner sleeve and faces outwardly of the associated liner sleeve. The other annular portion is stitched to an annular moisture barrier and faces inwardly of the associated shell sleeve. Each annular moisture barrier is disposed within the lower end of a liner sleeve with the top and bottom portions of the annular moisture barrier stitched to the associated shell sleeve.

8 Claims, 2 Drawing Sheets

FIREFIGHTER COAT WITH LINER SLEEVE WELLS AND WRISTERS

BACKGROUND OF THE INVENTION

The present invention relates to a firefighter coat wherein sleeve wells or water wells are disposed within the lower ends of the sleeves of the coat. This invention represents an improvement over the construction disclosed in U. S. Pat. No. 5,890,226, the disclosure of which is incorporated herein by reference.

As pointed out in the above patent, the sleeve wells prevent water from flowing into the sleeves especially when the arms of the firefighter are raised during firefighting activities. It has been found that when a wrister comes out of an associated coat sleeve during such activities, the snap fasteners employed in the patented construction tend to come undone. This, of course, is a very dangerous occurrence; and a solution to this problem became necessary.

In addition, the snap fasteners employed in each sleeve of the patented construction are four in number such that when snapped in place, the fasteners only provide a connection between the lower end of each liner sleeve and the lower end of the associated shell sleeve at four widely spaced points. This results in large gaps where the liner sleeves and the associated shell sleeves are not connected together. These gaps can allow water to flow into the shell sleeves. This problem required redesign of the connection between the liner sleeves and the associated shell sleeves to eliminate gaps in the connection.

SUMMARY OF THE INVENTION

The present invention incorporates a construction wherein the lower open ends of the sleeves of the liner are detachably connected to the lower open ends of the sleeves of the shell by attachment means in the form of two annular interengaging attachment portions. Each of the annular portions within a coat sleeve comprises part of a hook and loop fastening means such as VELCRO which enables quick and easy attaching and detaching of the lower end of a liner sleeve with respect to the associated shell sleeve. Since the attachment portions within each coat sleeve are annular in construction, there are no gaps formed between the interengaging attachment portions, thereby eliminating the undesirable gaps of the patented structure discussed above. This ensures that substantially no water can flow into the shell sleeves. Furthermore, the attachment between the liner sleeves and the shell sleeves is much more secure than is the case with spaced snap fasteners, thereby ensuring that the attachment portions will not be disengaged when a wrister comes out of an associated sleeve during firefighting activities.

Sleeve wells are provided within the lower ends of the liner sleeves of the present invention in the same manner as disclosed in the aforementioned patent.

One of the annular attachment portions within each coat sleeve is stitched to the lower end of the outer moisture barrier of the associated liner sleeve and faces outwards of the associated liner sleeve. The other of the annular attachment portions within each coat sleeve is stitched to an annular moisture barrier and faces inwardly of the associated shell sleeve. Each annular moisture barrier is disposed within the lower portion of an associated shell sleeve and has top and bottom portions which are stitched to the associated shell sleeve.

A band of trim material surrounds the lower end portion of each of the shell sleeves and is stitched thereto by a number of lines of stitching. The top portion of each annular moisture barrier is stitched to the associated liner sleeve at a region disposed above the band of trim material on the associated shell sleeve. Each annular moisture barrier thereby serves as a means for mounting an annular attachment portion, and further also prevents water which may enter through the stitching holding the band of trim material in place from moving upwardly within the associated shell sleeve. In addition, each annular moisture barrier also provides an extra layer of thermal protection for a firefighter.

DESCRIPTION OF THE PREFERRED EMBODIMENT

Figure 1:
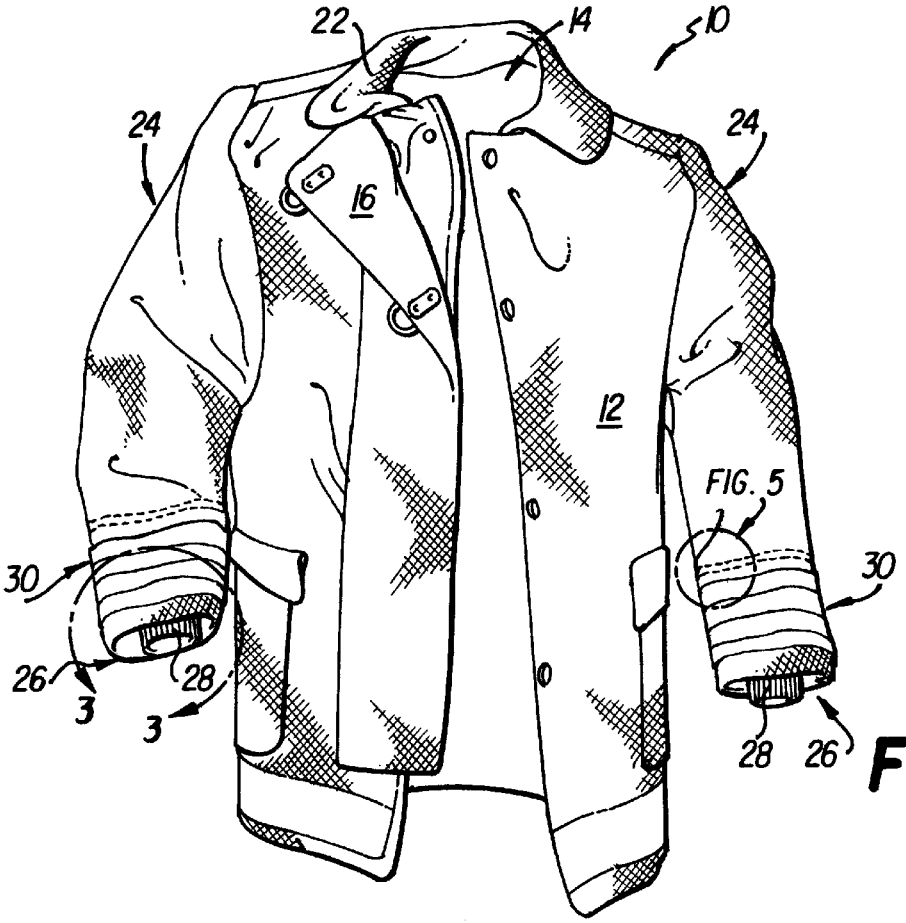
FIG. 1 is an elevation of a firefighter coat according to the invention.

Referring now to the drawings wherein like reference characters designate corresponding parts throughout the several views, there is shown in FIG. 1 a firefighter coat indicated generally by reference numeral 10 and being of conventional construction except for the wrister arrangement hereinafter discussed in detail. The coat includes an outer shell 12 which is formed of fire resistant material. The coat also includes an inner liner 14 of similar construction to that of the aforementioned patent except for the manner of attachment to the shell at the lower ends of the sleeves thereof. The liner may be detachably connected to the shell of the coat along the length of the neck line and to the coat facing in the same manner as the aforementioned patent.

Figure 5:
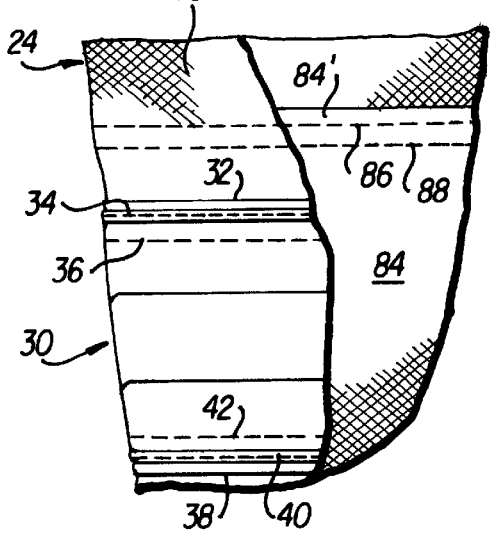
FIG. 5 is an enlarged view partly broken away of the portion of FIG. 1 indicated by arrow 5.

The coat includes an outside storm flap 16, and the coat may be held in closed position in a conventional manner. A collar 22 is provided, and a pair of sleeves 24 depend from the upper side portions of the coat, each of the sleeves terminating in an open lower end 26 having wristers 28 extending therefrom. A band of light reflective trim material 30 surrounds the lower end portions of each of the shell sleeves. Referring to FIG. 5, each band 30 has a top edge 32 with two parallel lines of stitching 34 and 36 extending around the band and disposed near the top edge 32. Each band 30 also includes a lower edge 38 with two parallel lines of stitching 40 and 42 extending around the band and disposed near the lower edge 38. The four lines of stitching 34, 36, 40 and 42 pass through the band and the associated shell sleeve for attaching the band of trim material to the shell sleeve.

Figure 2:
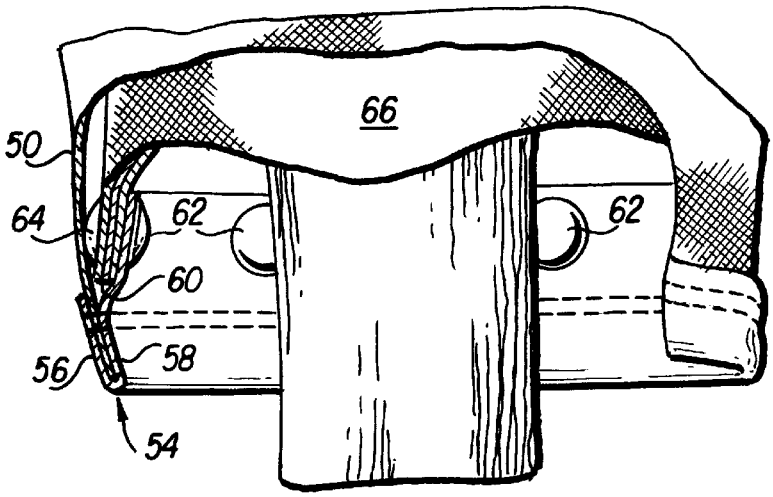
FIG. 2 (PRIOR ART)
FIG. 2 is a view partly broken away and partly in section showing the prior art.

Referring to FIG. 2, the prior art as disclosed in the above-mentioned patent is illustrated. In this construction, the shell material 50 of the sleeve extends downwardly to a lower edge 52. An attachment means 54 is of annular configuration and includes a first annular portion 56 which joins with a second annular portion 58, the two annular portions defining a cuff for the lower end of the sleeve. Annular portion 58 joins with an integral annular free annular portion 60 which has secured thereto four conventional female snap fasteners 62 which are equally spaced from one another in a circumferential direction. The fasteners 62 receive cooperating male snap fasteners 64 which are supported at the lower open end of the liner sleeve for detachably connecting the lower end of the liner sleeve to the lower end of the shell sleeve.

Figure 3:
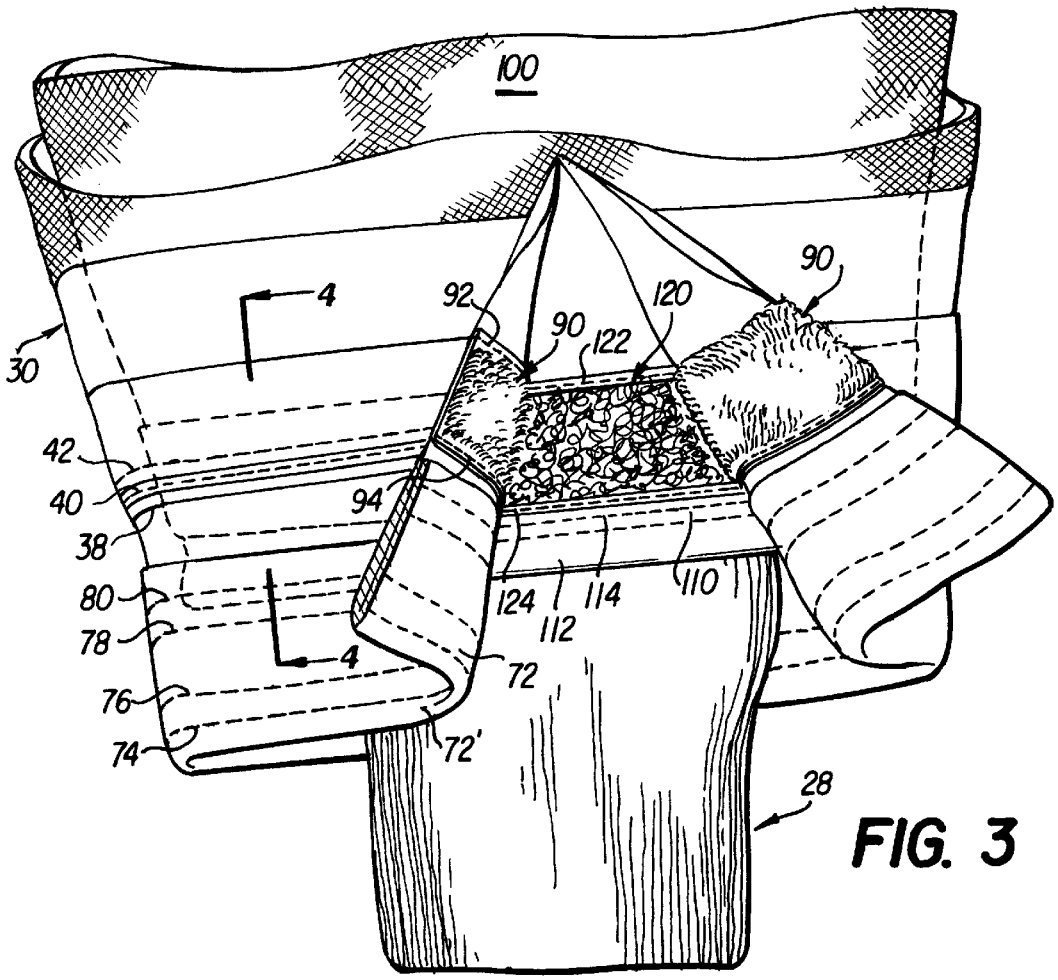
FIG. 3 is an enlarged view partly broken away of the portion of FIG. 1 indicated by arrow 3—3.
Figure 4:
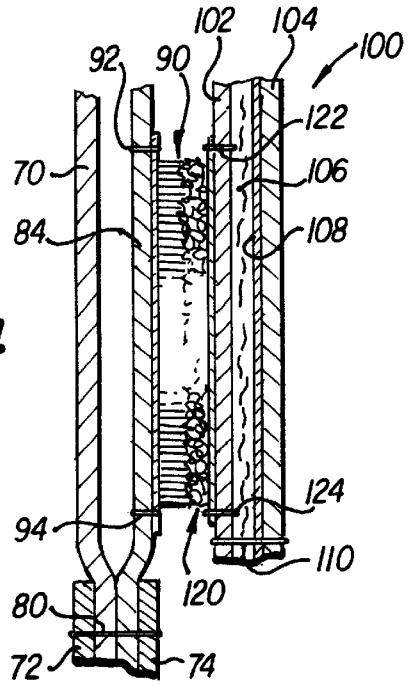
FIG. 4 is an enlarged sectional view taken along line 4—4 of FIG. 3.

The construction of one sleeve of the invention will now be described, it being understood that the construction of both sleeves is identical. As seen in FIGS. 3 and 4, the shell sleeve 70 has an annular cuff 72 disposed around the lower end of the shell sleeve. The cuff may be formed of suede material and is held in place by four parallel lines of stitching 74, 76, 78 and 80. As seen in FIGS. 4 and 5, an annular moisture barrier material 84 comprises a sheet of moisture barrier material disposed within the lower portion of shell sleeve 70. The lower edge (not shown) of the moisture barrier is disposed adjacent the lower edge (not shown) of the shell sleeve, the two lower edges being disposed adjacent the bight portion 72' of the cuff. The four lines of stitching 74, 76, 78 and 80 pass through the cuff 72, shell sleeve 70 and annular moisture barrier 84 to connect the lower portions of these components together. The upper portion 84' of moisture barrier 84 is stitched to the shell sleeve 70 by two parallel lines of stitching 86 and 88 at a region disposed above the top edge 32 of the band of trim material 30.

Attachment means is provided for detachably connecting the lower end of each liner sleeve with the lower end of the associated shell sleeve. The attachment means for each sleeve includes a first annular attachment portion 90 which comprises part of a hook and loop fastening means such as VELCRO. Portion 90 is supported on the annular moisture barrier 84 by two lines of stitching 92 and 94 and faces inwardly of the associated shell sleeve.

Referring to FIGS. 3 and 4, a liner sleeve 100 includes an outer moisture barrier 102 and an inner moisture barrier 104. A thermal barrier in the form of a layer 106 of aramid fibers which is quilted by stitching to a facecloth 108 is disposed between the inner and outer moisture barriers. The construction of the liner sleeve is similar to that of the aforementioned patent, the lower portions of the layers 102, 104, 106 and 108 being stitched together by a line of stitching 110 extending therethrough, and the lower portions of these layers being stitched to an annular band of material 112 by a line of stitching 114 as seen in FIG. 3 in the manner shown at the lowermost portion of FIG. 5 of the aforementioned patent. A sleeve or water well is formed in this invention in the same manner as disclosed in FIG. 4 of the patent. The lower end of the inner moisture barrier 104 of this invention is connected to the associated wrister 28 in the same manner as shown in the patent.

The attachment means also includes a second annular attachment portion 120 which comprises part of hook and loop fastening means such as VELCRO which is interengageable with the attachment portion 90. Portion 120 is supported on the outer moisture barrier 102 by two lines of stitching 122 and 124 and faces outwardly of the associated liner sleeve.

The invention has been described with reference to a preferred occur to others upon reading and understanding this specification. It is my/our intention to include all such modifications, alternatives and other embodiments insofar as they come within the scope of the appended claims or equivalents thereof.

What is claimed is:

1. A firefighter coat with liner sleeve wells and wristers comprising, an outer shell having a pair of shell sleeves each of which has an open lower end, a liner within said outer shell and having a pair of liner sleeves each of which has an open lower end, each of said liner sleeves being disposed within one of said shell sleeves, a pair of wristers, attachment means detachably connecting the lower end of each liner sleeve to the lower end of an associated shell sleeve and preventing liquid from flowing between the liner sleeve and the associated shell sleeve, each liner sleeve including an outer moisture barrier and an inner moisture barrier and a thermal barrier, the thermal barrier of each liner sleeve being disposed between said inner and outer moisture barriers thereof, the inner moisture barrier of each liner sleeve being connected to one of said wristers to form a sleeve well within the associated liner sleeve, each of said attachment means comprising first and second annular interengaging attachment portions, said first annular attachment portion being permanently interconnected with and facing inwardly of the associated shell sleeve, and said second annular attachment portion being permanently interconnected with and facing outwardly of the associated liner sleeve.

2. A firefighter coat as defined in claim 1 wherein each of said annular attachment portions comprises part of a hook and loop fastening means.

3. A firefighter coat as defined in claim 1 including an annular moisture barrier disposed within the lower portion of each of said shell sleeves, said annular moisture barrier having top and bottom portions which are stitched to the associated shell sleeve, said first annular attachment portion being stitched to said annular moisture barrier.

4. A firefighter coat as defined in claim 3 including a band of trim material surrounding the lower end portion of each of said liner sleeves and being stitched to the associated liner sleeve, the top portion of each of said annular moisture barriers being stitched to the associated shell sleeve at a region disposed above the band of trim material on the associated liner sleeve.

5. A firefighter coat as defined in claim 1 wherein said second annular attachment portion is supported on said outer moisture barrier layer of the associated liner sleeve.

6. A firefighter coat as defined in claim 1 wherein the inner moisture barrier of each liner sleeve extends upwardly from the lower end of and within the associated liner sleeve a substantial distance and is then folded downwardly a substantial distance to the location where the inner moisture barrier is connected to the associated wrister.

7. A firefighter coat as defined in claim 6 wherein said inner moisture barrier of each liner sleeve is connected at an intermediate portion thereof to the associated thermal barrier.

8. A firefighter coat as defined in claim 7 wherein said inner moisture barrier is connected to the associated thermal barrier by stitching extending circumferentially around the inner moisture barrier.

* * * * *